US008533865B2

(12) United States Patent
Tallon

(10) Patent No.: US 8,533,865 B2
(45) Date of Patent: Sep. 17, 2013

(54) APPARATUS FOR CHANGING INTO AND OUT OF SUITS ASSOCIATED WITH COLD WATER ACTIVITIES

(76) Inventor: Christopher Tallon, Hawthorne, CA (US)

( * ) Notice: Subject to any disclaimer, the term of this patent is extended or adjusted under 35 U.S.C. 154(b) by 145 days.

(21) Appl. No.: 13/134,081

(22) Filed: May 27, 2011

(65) Prior Publication Data

US 2012/0298161 A1 Nov. 29, 2012

(51) Int. Cl.
*A41D 13/00* (2006.01)

(52) U.S. Cl.
USPC ..... 2/82

(58) Field of Classification Search
USPC ..... 2/69, 69.5, 72, 76, 82, 86, 87, 89, 2/93, 88; 135/87, 90, 901, 902
See application file for complete search history.

(56) References Cited

U.S. PATENT DOCUMENTS

| | | | | | |
|---|---|---|---|---|---|
| 17,000 | A | * | 4/1857 | Segal | 604/59 |
| 44,606 | A | * | 10/1864 | Frazier | 83/422 |
| 61,940 | A | * | 2/1867 | NCazares | 196/14.5 |
| 143,773 | A | * | 10/1873 | Danilora | 30/164.9 |
| 170,104 | A | * | 11/1875 | Kalma | 292/277 |
| 179,132 | A | * | 6/1876 | Gutierrez | 220/626 |
| 204,375 | A | * | 5/1878 | Isswl | 160/99 |
| 249,527 | A | * | 11/1881 | Hunte | 91/151 |
| 471,373 | A | * | 3/1892 | Dumoulin | 52/651.01 |
| 2,372,110 | A | * | 3/1945 | Noone | 2/84 |
| 3,228,034 | A | * | 1/1966 | Grove | 5/413 R |
| 3,288,157 | A | * | 11/1966 | Szkolny | 135/95 |
| 3,798,676 | A | * | 3/1974 | Shanks et al. | 2/69.5 |
| 4,142,254 | A | * | 3/1979 | Arnold | 2/84 |
| 4,979,242 | A | * | 12/1990 | Maggio | 4/449 |
| 5,101,513 | A | * | 4/1992 | Bowers | 2/84 |
| 5,343,887 | A | * | 9/1994 | Danaher | 135/156 |
| 5,385,164 | A | * | 1/1995 | Sauter | 135/87 |
| 5,611,083 | A | * | 3/1997 | Arnold | 2/84 |
| 5,875,492 | A | * | 3/1999 | Moss | 2/93 |
| 6,488,188 | B2 | * | 12/2002 | Fleischli | 224/153 |
| 6,760,921 | B1 | * | 7/2004 | Simmons | 2/84 |
| 6,840,254 | B1 | * | 1/2005 | Windham | 135/91 |
| D541,011 | S | * | 4/2007 | Day et al. | D2/831 |
| 7,810,170 | B1 | * | 10/2010 | Guthrie | 2/69.5 |
| 7,849,866 | B1 | * | 12/2010 | Mangum | 135/96 |

* cited by examiner

*Primary Examiner* — Tejash Patel
(74) *Attorney, Agent, or Firm* — Edwin Tarver; Lauson & Tarver LLP

(57) ABSTRACT

A collapsible interactive personal privacy shelter for changing into and out of suits used in association with cold water activities and clothing that is portable and convieniant for use at the beach or anywhere it is desirable to change in open. The embodiment is non see thru light weight textile, trapezoidal in shape, open at the top with a draw cord, and has a flexible rubber base/changing matt. The enclosure rests upon the users hips when the draw cord is tightened. Openings on either side of the enclosure are covered by a privacy flap open on one side secured by Velcro. A rectangular transparent window and stretchable material run across the front mid-section of the enclosure. The bottom of the enclosure is of a durable material. A weep hole located in the bottom corner of the base releases trapped water.

6 Claims, 4 Drawing Sheets

APPARATUS FOR CHANGING INTO AND OUT OF SUITS ASSOCIATED WITH COLD WATER ACTIVITIES

REFERENCES CITED

U.S. Patent Documents

| | | | |
|---|---|---|---|
| 6,760,921 | July 2004 | Simmons | 2/84 |
| 5,611,083 | March 1997 | Arnold | 2/84 |
| *471,373 | December 2007 | Dumoulin | 2/69 |
| 0,179,132 | April 2001 | Gutierrez | 135/117 |
| *0,017,000 | July 2006 | Segal | 2/69 |
| 0,044,606 | July 2004 | Frazier | 002069000 |

FIELD OF INVENTION

The present invention related in general to collapsible cubicle devices providing privacy while changing clothes outdoors and in public. This invention lies in the field of portable enclosures for changing clothes and directed to such device which may be opened and closed quickly for storage and transportation. It is more particularly directed to portable changing tent which may be opened/closed very quickly with no need for special skills or manual dexterity and which is sufficiently rigid for general use in public.

BACKGROUND OF INVENTION

Many of the portable changing enclosures invented are open on the bottom and have a plurality of members which must be secured together with many fasteners requiring more time and dexterity to assemble. They provide limited privacy, are impractical, and offer no protection from the debris and rugged terrain that will damage suits worn in association with cold water activities.

BRIEF SUMMARY OF INVENTION

The principal objective of the invention to provide a wearable enclosure that provides privacy while changing in to and out of suits worn in association with cold water activities.

Another objective is to provide a stable and protective surface to change upon preventing damage and soiling of suits.

It is also an objective of the present invention that it interact with the users physical movements required to disrobe from suits worn in association with cold water activities.

A further objective of the invention is that it be made in the US and that it be partially comprised of recycled materials.

Still a further objective is to provide such a device in non see thru, lightweight textile, easy to use, and easily stored in devices such as but not limited to backpacks and duffle bags.

From forgoing general description of the invention achieves, as an important objective, said invention is made in a range of sizes for both sexes each size large enough to allow the user to change freely and safely.

The forgoing objects can be accomplished by providing a device that combines a half length trapezoidal, non see thru, light weight textile comprised of two side panels, a front panel, a rear panel, stitched together, and a durable material along the bottom of the enclosure wall minimizing damage. The top portion has an opening with a draw cord waist that rests upon the hips when tightened. Once the user is standing upon the flexible rubber base the enclosure wall is easily pulled up and over the users hips. Two openings located on either side of the enclosure wall from the upper thigh down below the knee allow the user to disrobe and exchange clothing, a privacy flap open on one side attached by a hook and loop fastener covers the opening on the inside, a transparent vinyl window just below the knees provides additional safety and control when changing. The bottom of the enclosure wall is adhered to a flexible rubber base enclosing the user from the waist down. The bottom of the flexible rubber base is textured adding traction, the top of the flexible rubber base has a 5 mil. thick textured neoprene matt protecting suits from damage and providing additional traction and comfort when changing. The flexible rubber base interacts with the users physical movements required to disrobe.

| REFERENCE NUMERALS IN DRAWINGS: | |
|---|---|
| 1. | an enclosure wall |
| 2. | a wall |
| 3. | a top opening |
| 4. | an enclosed flexible rubber base |
| 5. | a front panel |
| 6. | a side panel |
| 7. | stitching |
| 8. | a stretchable material |
| 9. | a transparent vinyl window |
| 10. | draw cord waist |
| 11. | openings in side panels |
| 12. | privacy flap |
| 13. | open side of wind flap |
| 14. | a hook and loop fastener |
| 15. | opening in side panel |
| 22. | bottom of enclosure wall |
| 23. | textured bottom of flexible rubber base |
| 24. | |
| 25. | textured neoprene rubber matt |
| 26. | rubber channel |
| 27. | interactive flexible rubber base |
| 28. | a and b of users physical posture |

DETAILED DESCRIPTION OF INVENTION

The following detailed description represents the best currently contemplated modes of carrying out the invention. The description is not to be taken in a limiting sense, but is made merely for the purpose of illustrating the general principals of the invention.

Figure 1:
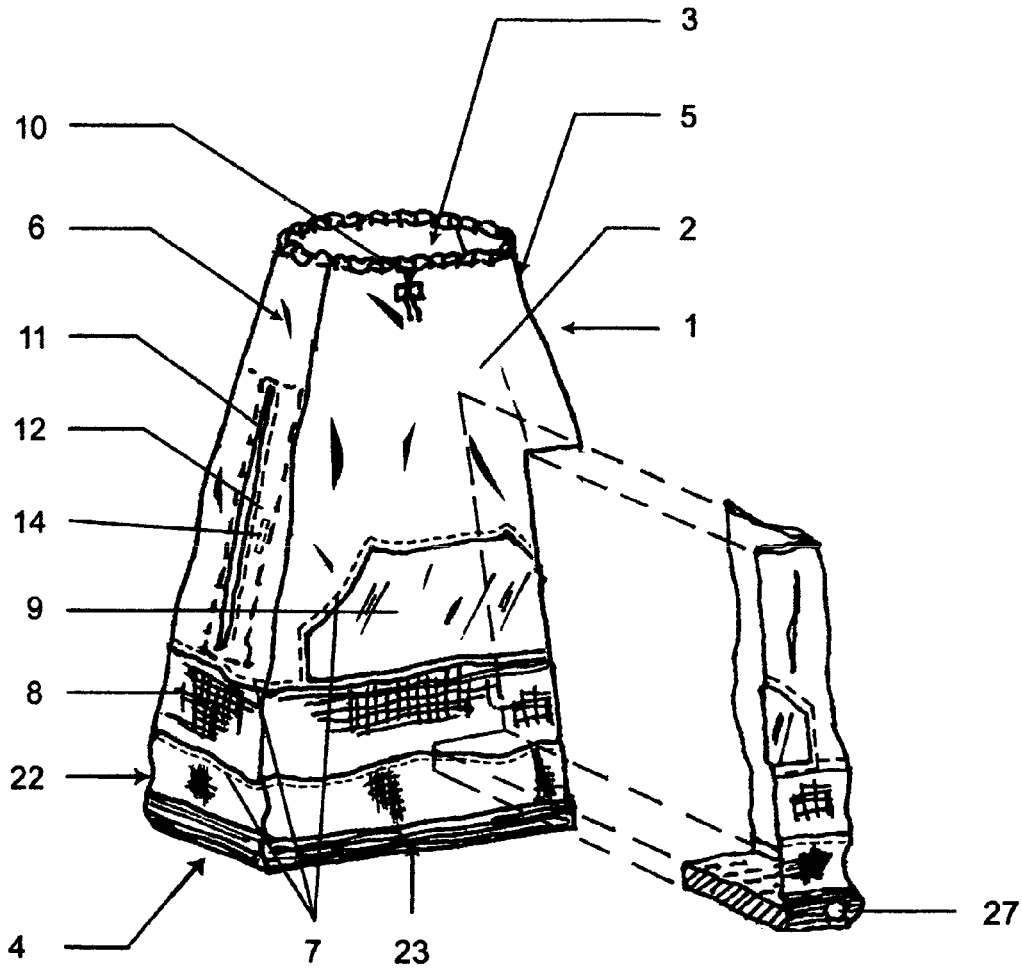
FIG. 1 illustrates an axonometric projection of an enclosure according to an embodiment of the invention.

Referring to FIG. 1, an enclosure (1) that may be portable and easily used may be of generally trapezoidal form having a wall (2), an open top (3), and an enclosed flexible rubber base (4). The wall (2) may be made of lightweight, non see through textile cut into four panels; a front and back (5), and two sides (6) sewn (7). All four panels (5,6) taper at the top forming an opening (3) for the waist.

As shown in FIG. 1,3,4 there may be a draw cord waist that when tightened allows the enclosure to rest upon the users hips.

Figure 3:
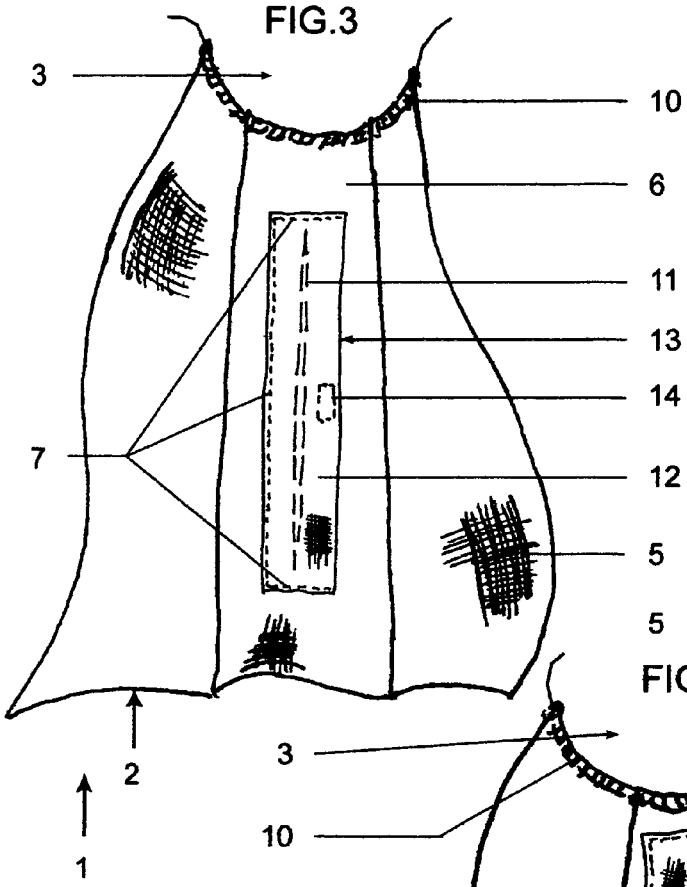
FIG. 3 illustrates a side view of an enclosure and an interior covered opening according to the embodiment of the invention.
Figure 4:
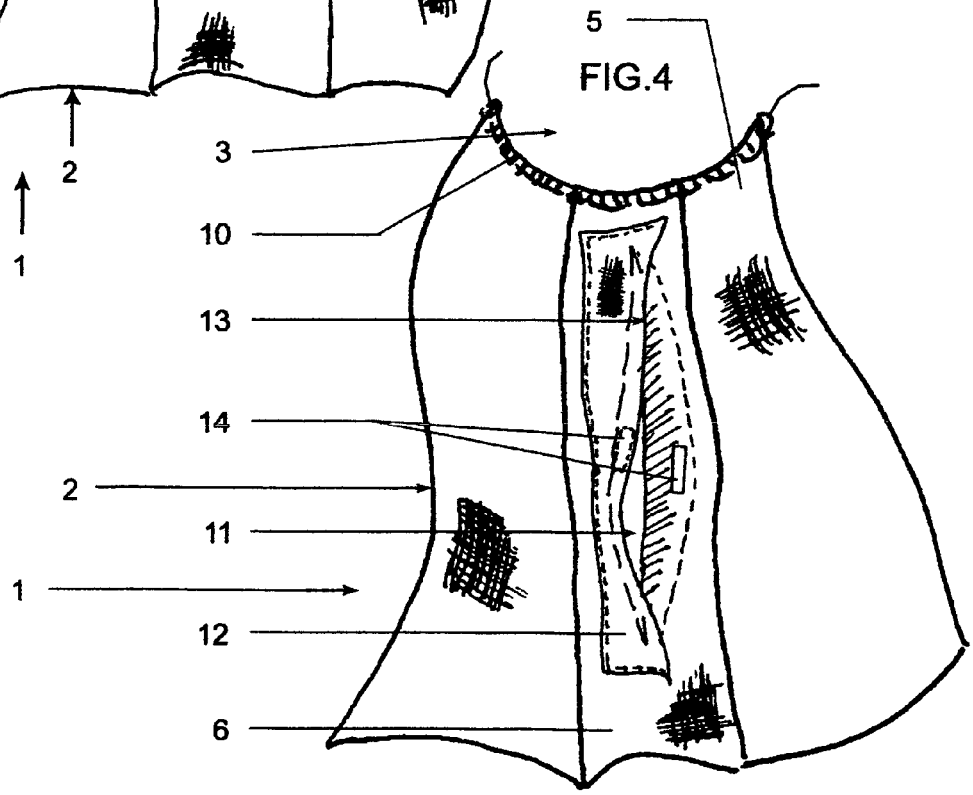
FIG. 4 illustrates an partial axonometric projection of an enclosure and an interior covered opening in its functional condition according to the embodiment of the invention.

There may be openings (11) cut and hemmed down the center of each side panel (6) as shown in FIGS. 1,3, and 4 from the upper thigh down below the knee. On the inside of the enclosure wall over the opening (11) may be a privacy flap (12) which may be sewn to a wall on three sides and which may be open down the side (13) facing the front of the enclosure wall that may be closed by a hook and loop fastener (14).

Figure 5:
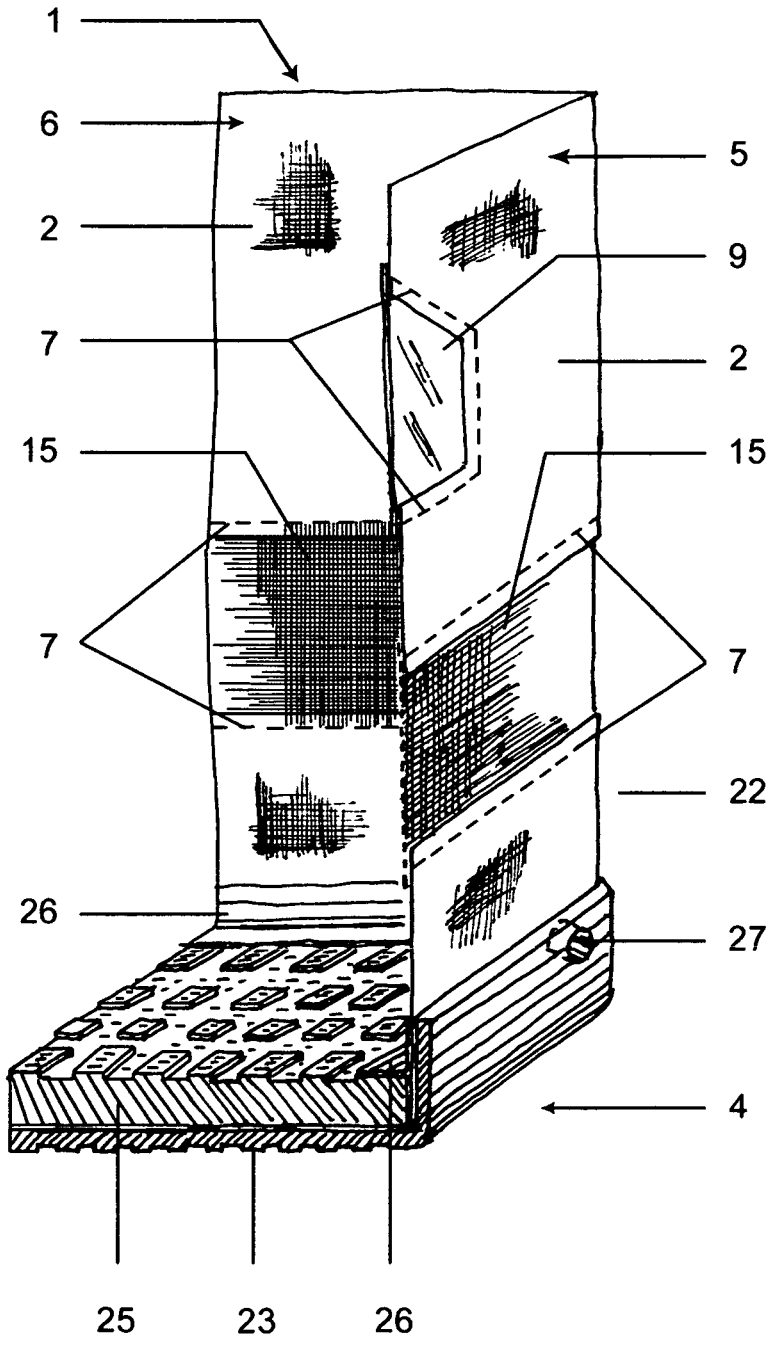
FIG. 5 illustrates a axonometric projection of an enclosure and flexible rubber base according to an embodiment of the invention.

As shown in FIGS. 1,5, there may be a transparent vinyl window (9) positioned below the knees across the front wall which may be sewn (7).

As shown in FIG. 5, there may be a stretchable material (8) below a vinyl window (9) that may transition into a durable material at the bottom of the enclosure wall (22) which is enclosed by a flexible rubber base (4) with a textured bottom (23) which may be attached to the enclosure wall by high strength adhesive. Upon the top of the flexible rubber base (4) may be a 5 millimeter thick rubber neoprene textured matt (25) which may be adhered to the flexible rubber base. As shown in FIG. 5, there may be a two inch wide rubber channel (26) adhered along the perimeter of an interior edge between the bottom of the enclosure wall (22) and a neoprene rubber matt (25) which may include a weep hole (27) in one corner.

Figure 2:
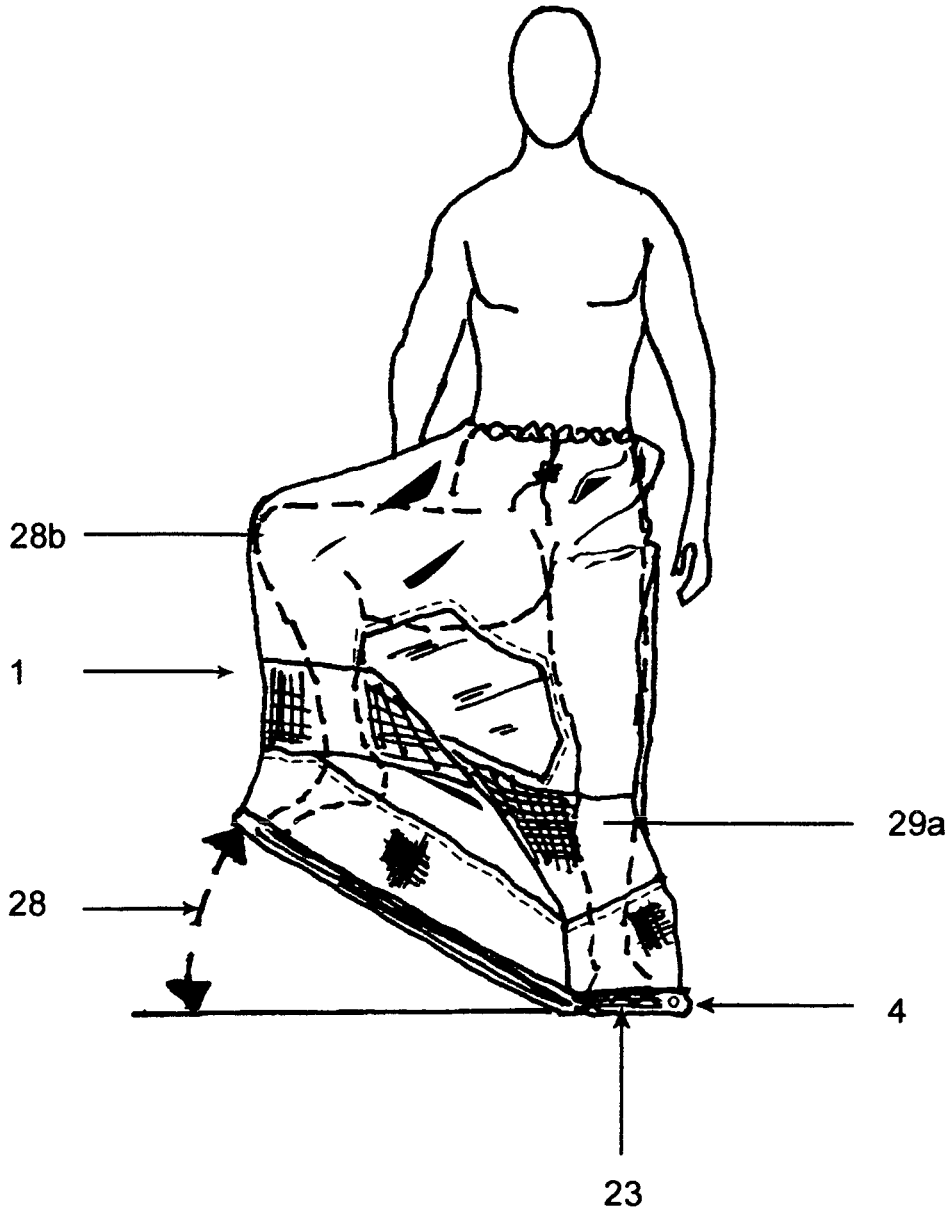
FIG. 2 illustrates the functional condition of an enclosure as it interacts with the physical movements of the user according to an embodiment of the invention.

Referring to FIG. 2, the embodiment of invention (1) which may be of generally trapezoidal form having a wall (2), an open top (3), and a closed base (4) as shown in FIG. 1 which may be enclosed by a flexible rubber base (4) with a textured bottom (23) having a 5 millimeter thick textured neoprene rubber matt (25) upon the inside as shown in FIG. 5 interacts (28) with the users physical movements (29*a*,29*b*, 29*c*) required to disrobe.

I claim:

1. A portable interactive changing pod, comprising:

a lightweight, opaque textile, open top enclosure, and an enclosed flexible rubber base;

wherein the enclosure comprises a wall and contains a draw cord at waist height which rests upon a user's hips when tightened;

wherein the enclosure wall is of a generally trapezoidal shape, comprising four panels stitched together and having a first opening and a second opening;

wherein the first opening and second opening are covered on the inside of the enclosure wall by a privacy flap; and wherein the enclosure wall comprises a flexible window, a stretchable material, and wherein the enclosure all is enclosed by a flexible rubber base.

2. The changing pod of claim 1 wherein the draw cord is adapted to be tightened to rest upon a users hips.

3. The changing pod of claim 1 wherein the first opening and second opening extend from a user's upper thigh to an area below the knee.

4. The changing pod of claim 3 including a privacy flap open on one side and attached by a hook and loop fastener covering the first opening and second opening on the inside of the enclosure wall.

5. The changing pod of claim 1 including a flexible transparent vinyl window below a user's knees.

6. The changing pod of claim 1 wherein the flexible rubber base incorporates a weep hole in one corner to allow water to escape.

* * * * *